United States Patent [19]

Maser

[11] 4,300,029

[45] Nov. 10, 1981

[54] REMOTE MEMBRANE SWITCH

[75] Inventor: Thomas L. Maser, Whitefish Bay, Wis.

[73] Assignee: W. H. Brady Co., Milwaukee, Wis.

[21] Appl. No.: 110,645

[22] Filed: Jan. 9, 1980

[51] Int. Cl.[3] ..... H01H 3/12; H01H 3/20

[52] U.S. Cl. ..... 200/159 B; 200/83 R; 200/83 N; 206/331

[58] Field of Search ..... 200/159 B, 331, 340, 200/314, 302, 292, 5 E, 83 R, 83 N, 83 A, 83 Z

[56] References Cited

U.S. PATENT DOCUMENTS

| | | | |
|---|---|---|---|
| 3,234,739 | 2/1966 | Pierce, Jr. | 50/62.6 |
| 3,267,233 | 8/1966 | Basile et al. | 200/83 N |
| 3,524,031 | 8/1970 | Mack | 200/83 N |
| 3,571,542 | 3/1971 | Madden | 200/83 N |
| 3,699,294 | 10/1972 | Sudduth | 200/83 R |

*Primary Examiner*—Willis Little

[57] ABSTRACT

A multi-layered flexible switch wherein the electrical contacts are transversely remote from the area of the switch to be depressed.

8 Claims, 2 Drawing Figures

FIG 1
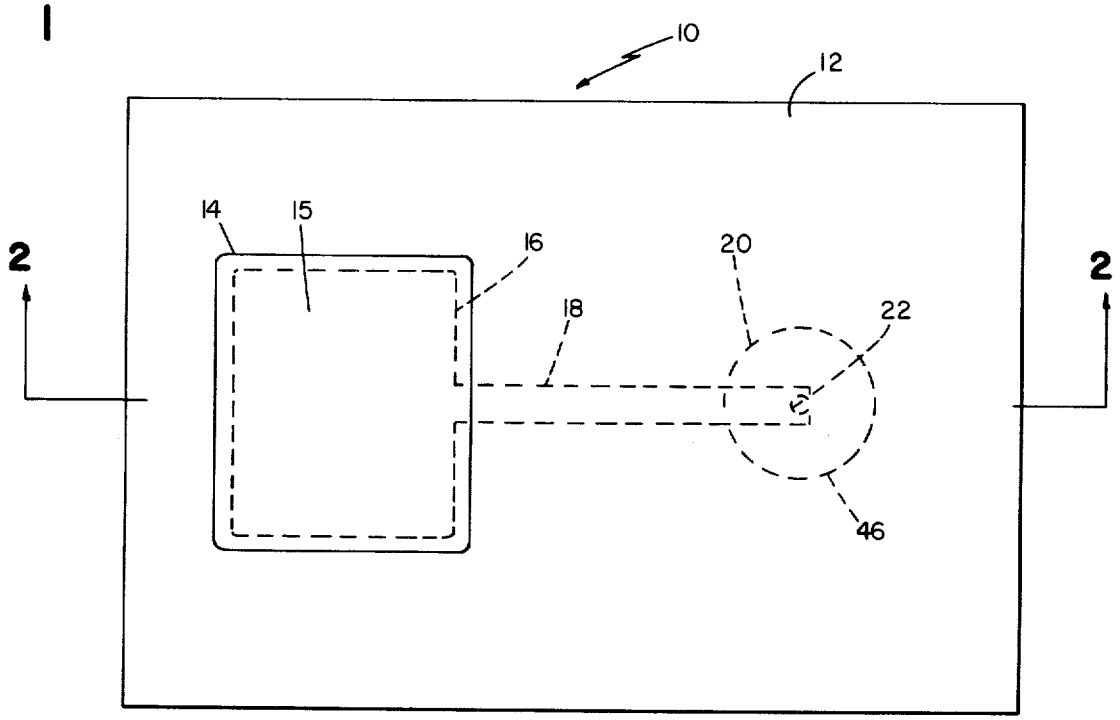
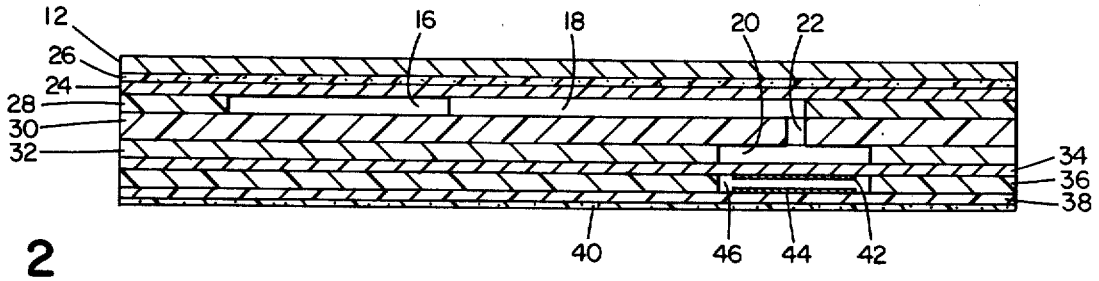
FIG 2

REMOTE MEMBRANE SWITCH

FIELD OF THE INVENTION

This invention relates to multi-layered membrane switches.

BACKGROUND OF THE INVENTION

Backlighting is generally provided for switch panels by placing a light source behind transparent switch areas. Because membrane switches typically have opaque electrical contacts within the switches immediately below the switch depressing areas, it is often impossible to have a fully backlit switch area. This creates limitations in low light areas of being able to locate and read the switches on a panel.

SUMMARY OF THE INVENTION

I have discovered that full backlighting can be provided for a membrane switch by placing the contacts within the switch remotely from the area to be depressed. The contacts are spaced apart, carried by different layers, and actuated by increased pressure on the non-carrying surface of a flexible contact-supporting layer, the pressure being caused by decreasing the volume in a primary chamber directly below the switch depressing area and communicating with a secondary chamber partially bounded by the non-carrying surface of the flexible contact-supporting layer.

PREFERRED EMBODIMENT

I turn now to description of the drawings and the structure and operation of a preferred embodiment.

DRAWINGS

FIG. 1 is a diagrammatic plan view of a switch according to the invention.

FIG. 2 is a vertical sectional view, taken at 2—2, of said switch.

STRUCTURE

In FIG. 1 is shown membrane switch 10 having face layer 12 made of transparent polycarbonate 10 mils thick having a texturized upper surface and line 14 of opaque ink on its bottom surface indicating a switch depressing area 15. Indicia can also be inked on the bottom surface of layer 12. Also shown are primary chamber 16 and passage 18, which connects the primary chamber to the secondary chamber 20 via hole 22.

Referring to FIG. 2, face layer 12 is adhered to primary flexible layer 24 (5 mils thick polyester) by adhesive layer 26 (2 mils thick acrylic thermosetting adhesive). Beneath flexible layer 24 is spacer layer 28 (5 mils thick polyester sandwiched between 2 mils thick layers of acrylic thermosetting adhesive), which is shown diagrammatically in FIG. 2. Therebeneath is less-flexible spacer layer 30 (30 mils thick polycarbonate); spacer layer 32 (similar to layer 28); secondary flexible layer 34 (5 mils thick polyester); contact spacer layer 36 (similar to layer 28); lower contact support layer 38 (5 mils thick polyester); and finally adhesive layer 40 (2 mils thick layer of cured acrylic adhesive). A release sheet (not shown), which will be removed prior to use, is beneath adhesive layer 40. Primary chamber 16 and passage 18 are partially defined by cut out portions within spacer layer 28. Hole 22 is defined by a cut out portion of less-flexible layer 30. Contacts 42, 44 are carried by the lower surface of secondary flexible layer 34 and the upper surface of lower contact support layer 38, respectively, within switch chamber 46 located directly below secondary chamber 20. Contacts 42, 44 are pads of conductive silver paint about 0.4 mil thick and sold by Acheson Colloids of Port Huron, Mich., under the designation Electrodag 415SS. The contacts 42, 44 are connected to external leads (not shown) for connection to external circuitry.

OPERATION

In operation switch 10 is mounted with a light source underneath transparent switch depressing area 15. When face layer 12 is depressed by a finger at area 15, primary flexible layer 24 will be depressed, thereby decreasing the volume of primary chamber 16, forcing air to flow through passage 18 and increasing the pressure in secondary chamber 20, thereby depressing secondary flexible layer 34 and making contact between contacts 42, 44. Less-flexible spacer layer 30 ensures that the volume of primary chamber 16 will decrease when flexible layer 24 is depressed and prevents electrical contact from being made when face layer 12 is depressed in an area other than area 15.

What is claimed is:

1. A multi-layered flexible switch comprising:

a first chamber-defining layer, a second, apertured, chamber-defining layer beneath said first layer, a third chamber-defining layer beneath said second layer, said second chamber-defining layer being less flexible than said first chamber-defining layer, and said third chamber-defining layer cooperating with said first chamber-defining layer and said second chamber-defining layer to define a primary chamber, switch chamber means transversely spaced from said primary chamber to define a switch chamber, said switch chamber being partially defined by a switch chamber-defining flexible layer carrying in said switch chamber a first contact normally spaced from a second contact, which switch chamber-defining flexible layer when depressed brings said contacts together, and means providing a transversely-extending conduit from said primary chamber to said switch chamber-defining flexible layer for transmitting pressure generated in said primary chamber by depression of said first layer to said switch chamber-defining flexible layer to thereby activate said switch.

2. The switch of claim 1 in which said flexible layer cooperative with said switch chamber means is a fourth layer.

3. The switch of claim 2 in which said conduit comprises an aperture in said second chamber-defining layer communicating with a hole in said third chamber-defining layer.

4. The switch of claim 3 in which said fourth layer is secured to said third layer by an intermediate layer apertured to provide a secondary chamber.

5. The switch of claim 1 wherein said first and third layer are transparent in the region of said primary chamber to thereby provide a light transmissive path through said switch for backlighting a switch-depressing area above said primary chamber.

6. The switch of claim 1 wherein said switch chamber means is beneath said third layer and said second layer is sufficiently less flexible than said first layer to prevent switch activation from occurring if said first layer is depressed in areas other than a switch depressing area above said primary chamber.

7. A multi-layered flexible switch comprising:

a multiplicity of layers, said multiplicity defining a contact chamber and a pressurization chamber, one of said multiplicity being a flexible layer between said contact chamber and said pressurization chamber, and a first contact carried by said flexible layer in said contact chamber, a second contact normally spaced from said first contact in said contact chamber, means for changing pressure in said pressurization chamber so as to move said flexible layer sufficiently to bring together said contacts in said contact chamber, and conduit means joining said means for changing pressure and said contact chamber.

8. The switch of claim 7 in which said means for changing pressure is means for increasing pressure in said pressurization chamber.

* * * * *